US010290972B2

(12) United States Patent
Gunreben et al.

(10) Patent No.: US 10,290,972 B2
(45) Date of Patent: May 14, 2019

(54) ELECTRICAL CONNECTOR ASSEMBLY

(71) Applicant: Aptiv Technologies Limited, St. Michael (BB)

(72) Inventors: Michael Gunreben, Schwanstetten (DE); Partheeban Loganathan, Chennai (IN)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 15/953,609

(22) Filed: Apr. 16, 2018

(65) Prior Publication Data

US 2018/0316130 A1 Nov. 1, 2018

(30) Foreign Application Priority Data

Apr. 27, 2017 (EP) ..... 17168508

(51) Int. Cl.
*H01R 13/627* (2006.01)
*H01R 13/639* (2006.01)
(Continued)

(52) U.S. Cl.
CPC ..... *H01R 13/6273* (2013.01); *H01R 13/5025* (2013.01); *H01R 13/629* (2013.01);
(Continued)

(58) Field of Classification Search
CPC ..... H01R 13/6273; H01R 13/629; H01R 13/5025; H01R 13/639; H01R 24/28; H01R 2103/00; H01R 2201/26
(Continued)

(56) References Cited

U.S. PATENT DOCUMENTS 5,435,742 A 7/1995 Cecil
5,591,041 A * 1/1997 Cecil, Jr. ..... H01R 13/506 439/352

(Continued)

FOREIGN PATENT DOCUMENTS

EP 734101 A2 9/1996
EP 2685570 A1 1/2014
WO 2014087430 A1 6/2014

*Primary Examiner* — Abdullah A Riyami
*Assistant Examiner* — Nelson R. Burgos-Guntin
(74) *Attorney, Agent, or Firm* — Robert J. Myers

(57) ABSTRACT

An electrical connector assembly for airbag restraint systems comprising a first connector, comprising an elongated housing aligned along a longitudinal axis, a first connector's connection face facing perpendicular to the longitudinal axis, along a mating axis perpendicular to the longitudinal axis, said first connector comprising first locking means to lock the first connector to a second connector and second locking means that prevent the first locking means from releasing, the connector assembly further comprising the second connector, comprising a second connector's connection face surrounded at least partly by a shroud, facing along the mating axis towards the first connector's connection face. The shroud comprises third locking means that cooperate with the first locking means to lock the first connector to the second connector when mated along the mating axis. The extension of the mated connector assembly, along the mating axis, is smaller than the extension along the longitudinal axis and also smaller than the extension along a transverse axis arranged perpendicular to the longitudinal axis and the mating axis.

15 Claims, 6 Drawing Sheets

(51) Int. Cl.

| | |
|---|---|
| ***H01R 13/502*** | (2006.01) |
| ***H01R 13/629*** | (2006.01) |
| ***H01R 13/641*** | (2006.01) |
| *H01R 103/00* | (2006.01) |
| *H01R 24/28* | (2011.01) |
| *H01R 13/631* | (2006.01) |

(52) U.S. Cl.
CPC ..... *H01R 13/639* (2013.01); *H01R 13/641* (2013.01); *H01R 13/631* (2013.01); *H01R 24/28* (2013.01); *H01R 2103/00* (2013.01); *H01R 2201/26* (2013.01)

(58) Field of Classification Search
USPC ..... 439/347, 352, 685, 682, 350, 689
See application file for complete search history.

(56) References Cited

U.S. PATENT DOCUMENTS 6,341,972 B1 * 1/2002 Odorfer ..... H01R 13/582 439/352
6,530,799 B2 * 3/2003 Regnier ..... H01R 13/6273 439/352
6,705,886 B1 * 3/2004 Brown ..... H01R 13/641 439/352
6,866,534 B2 * 3/2005 Hirschmann ..... H01R 13/639 439/188
7,108,540 B2 * 9/2006 Annecke ..... H01R 13/6275 439/352
7,121,867 B2 * 10/2006 Annecke ..... H01R 13/6273 439/352
7,131,854 B1 * 11/2006 Pavlovic ..... H01R 13/6273 439/352
7,306,474 B1 * 12/2007 Brown ..... H01R 13/506 439/352
7,344,403 B2 * 3/2008 Major ..... H01R 13/506 439/352
7,396,253 B2 * 7/2008 Nakamura ..... H01R 13/641 439/188
7,744,432 B2 * 6/2010 Son ..... F42B 3/04 439/352
8,968,021 B1 * 3/2015 Kennedy ..... H01R 13/6273 439/352
9,017,090 B2 * 4/2015 Matsumoto ..... H01R 13/6275 439/350
9,039,438 B2 * 5/2015 Gunreben ..... H01R 13/6273 439/352
9,325,114 B2 * 4/2016 Miklinski ..... H01R 13/6273
9,409,536 B2 * 8/2016 Gunreben ..... B60R 21/16
9,520,674 B2 * 12/2016 Regnier ..... H01R 13/639
2004/0192099 A1 * 9/2004 Seminara ..... H01R 13/6273 439/352
2004/0248454 A1 * 12/2004 Gunreben ..... H01R 13/639 439/352
2006/0084314 A1 * 4/2006 Takizawa ..... H01R 13/73 439/352
2007/0254518 A1 * 11/2007 Nealle ..... H01R 13/6277 439/352
2013/0276659 A1 10/2013 Hubbard et al.
2014/0087430 A1 3/2014 Lee et al.
2015/0093928 A1 * 4/2015 Chen ..... H01R 13/6273 439/352
2016/0118745 A1 * 4/2016 Droesbeke ..... H01R 13/4368 385/76

* cited by examiner

ELECTRICAL CONNECTOR ASSEMBLY

CROSS-REFERENCE TO RELATED APPLICATION

This application claims the benefit under 35 U.S.C. § 119(a) of patent application Ser. No. 17/168,508.4 filed in the European Patent Office on Apr. 27, 2017, the entire disclosure of which is hereby incorporated by reference.

TECHNICAL FIELD OF THE INVENTION

The present invention relates to an electrical connector assembly particularly useful with airbag restraint systems.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
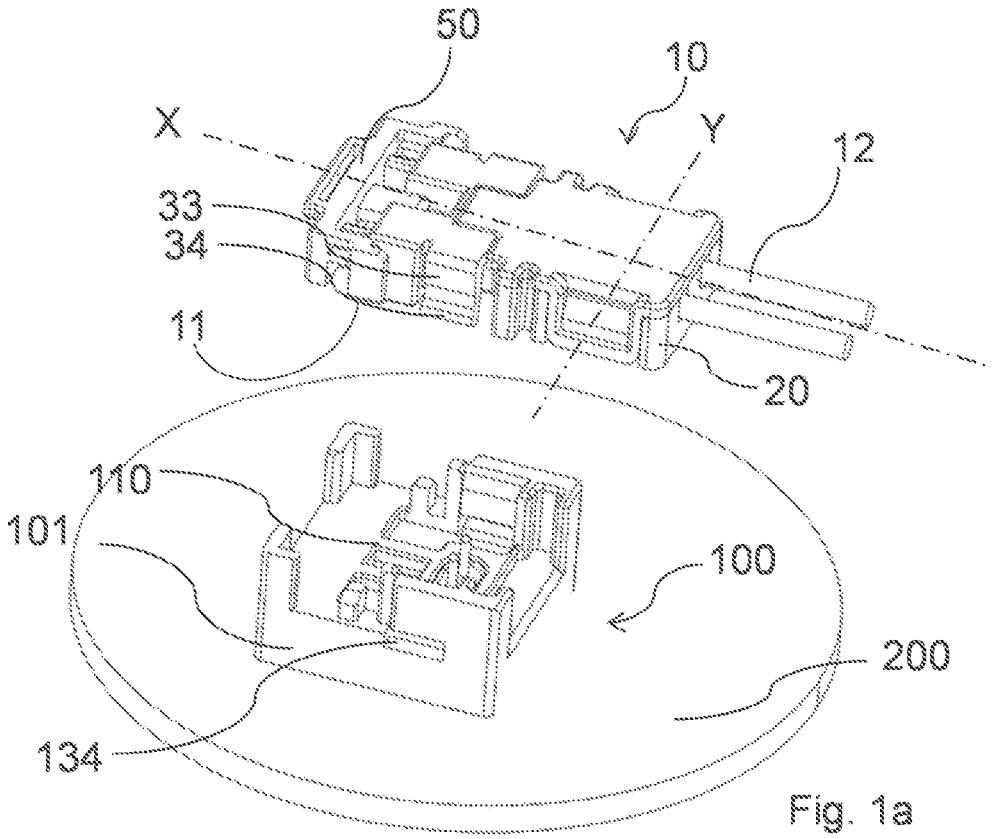
FIG. 1*a* shows a schematic illustration of a connector assembly in a disconnected state in accordance with one embodiment.

An electrical connector assembly suitable for airbag restraint systems shown in FIGS. 1*a* through 6*b* is described herein. The electrical connector assembly includes a first connector having an elongated housing aligned along a longitudinal axis and a first connector connection face facing perpendicular to the longitudinal axis, along a mating axis perpendicular to the longitudinal axis. The first connector includes first locking means to lock the first connector to a second connector and second locking means that prevent the first locking means from releasing. The electrical connector assembly further includes a second connector having a second connection face surrounded at least partly by a shroud, facing along the mating axis. The second connection face is oriented towards the first connection face. The shroud includes a third locking means that cooperates with the first locking means to lock the first connector to the second connector when mated along the mating axis. The length of the mated connector assembly, along the mating axis is smaller than the width along the longitudinal axis and also smaller than the height along a transverse axis arranged perpendicular to the longitudinal axis and the mating axis.

The electrical connector assembly provides a flat connector structure that can be used in narrow environments. The first connector and the second connector are small relative to the mating axis. Furthermore, the first connector is preferably fully received in the second connector. That is why the length in mating direction is dependent only on the second connector. The locking means act only in directions perpendicular to the mating axis and do not require additional length along the mating direction. Accordingly, there is no need to reserve free space above the first connector in the environment, because the locking means is operated perpendicular to the mating axis. This makes the handling during assembly easier.

According to one embodiment, the first locking means is a protrusion protruding outwards from the elongated housing, along the transverse axis. Because the protrusion protrudes along the transverse axis it doesn't increase space requirement along the mating axis. The protrusion can be designed to extend a distance along the longitudinal axis to be more robust.

According to one embodiment, the protrusion is arranged on a free end of a flexible arm. The flexible arm extends from the elongated housing along the mating axis towards the second connector. The flexible arm provides flexibility in the way that the protrusion can be displaced inwardly to the elongated housing by the shroud, while mating. Because the flexible arm extends towards the second connector the protrusion comes in contact with the shroud in an early state of mating, the flexible arm, displaced inwardly, is protected from damages.

According to one embodiment, the flexible arm extends along mating axis at the same distance as the elongated housing. To increase the flexibility of the flexible arm it should be as long as possible but not increase the size of the first connector.

According to one embodiment, third locking means is an edge defined by a recess in an inner wall of the shroud. An economical way to provide the edge in the shroud is to provide a recess. If necessary, a cavity can also be provided in the shroud.

According to one embodiment, the second locking means is a connector position assurance device that is attached to the elongated housing. The connector position assurance device is movable along the longitudinal axis between an open position and a blocked position, when the connector assembly is mated. The second locking means prevents the connector assembly from accidentally disconnecting. The second locking means is operable along the longitudinal axis and needs no additional space, neither along the transverse axis nor along the mating axis.

According to one embodiment, the connector position assurance device includes main part aligned along the transverse axis. The main part has some functions. It works with handle for the operator while mating the connectors, especially while locking the second locking means. Furthermore the main part works as start point for protrusions needed by the connector position assurance device. Finally the main part defines the wall of the elongated housing in a finally assembled state.

According to one embodiment, the connector position assurance device includes a bar shaped portion protruding from the main part along the longitudinal axis towards the elongated housing. The elongated housing includes a guide cavity aligned along the longitudinal axis. The bar shaped portion is movable inside the guide cavity along the longitudinal axis when the connector assembly is mated. A portion of the guide cavity surrounding wall is defined by the flexible arm. While mating the flexible arm is bent, at least partly, into the guide cavity. When finally mated the flexible arm is relaxed again, the protrusion protrudes in a predefined opening. The flexible arm defines a portion of the wall, surrounding the guide cavity. The guide cavity is ready to receive the bar shaped portion. The bar shaped portion fills the guide cavity when in the closed position thereby preventing movement of the flexible arm. Without movement of the flexible arm the protrusion is held securely in the predefined opening and locks the first and the second connectors.

According to one embodiment, the bar shaped portion and the guide cavity have a rectangular cross section. A rectangular cross section provides good guiding abilities.

According to one embodiment, the elongated housing includes openings for guide through electrical wires. The connector position assurance device is attached opposite to the openings at the elongated housing. The connector position assurance device is moved towards the openings while moving from the open position to the blocked position. This arrangement allows, while manually assembling the connectors, holding and guiding the first connector to the correct position using a first hand by holding the electrical wires. In the correct position the connectors can be plugged to and locked by a second hand. The electrical wires do not disturb the operating of the position assurance device.

According to one embodiment, the first connector includes terminals and the second connector includes contact elements. In a plane, spanned by the longitudinal axis and transverse axis, at least, a portion of the terminals and a portion of the contact elements and a portion of the bar shaped portion and a portion of the flexible arm, is present in one point along the mating axis. This design provides a robust connector. The contact elements are surrounded by the locking means especially in the area where they make contact. This promises high reliability of the electrical connection.

According to one embodiment, the first connector includes terminals and the second connector includes contact elements. Contacting points between the terminals and the contact elements and a portion of the bar shaped portion and a portion of the flexible arm is arranged in a row along the transverse axis. This design provides also a robust connector. The contact elements are adjacent to the locking means. This arrangement of contact elements and locking means promises high reliability of the electrical connection.

According to one embodiment, the connector position assurance device includes a safety arm to block the connector position assurance device in an unmated condition. The safety arm protruding from the main part along the longitudinal axis towards the elongated housing includes an outwardly sloped safety surface that is arranged on the safety arm. The second connector includes a post protruding along the mating axis, having an inwardly sloped release surface and after mating the sloped safety surface and the sloped release surface cooperate in the way that the safety arm is moved outwardly and the connector position assurance device is movable from the open position to the blocked position. This arrangement prevents an unwanted movement of the position assurance device while the first connector is not connected to the second connector. While mating the connector position assurance device is released.

According to one embodiment, the position assurance device includes a final lock protrusion protruding along the mating axis. The final lock protrusion projects from the free end of a final lock arm, protruding from the main part along the longitudinal axis towards the elongated housing. The final lock protrusion is adapted to cooperate with an edge in the elongated housing to lock the position assurance device in the blocked position. This arrangement prevents an unwanted movement of the position assurance device when the first connector and the second connector are finally connected, by locking the position assurance device to the first connector.

According to one embodiment, the elongated housing includes a rib extending along the mating axis and the shroud includes a groove extending along the mating axis. The rib is received in the groove while mating, guiding the connectors while mating. The rib engages with the groove at the beginning of the mating process and guides the first connector precisely along mating axis towards the second connector. This prevents damages at the contact elements.

Figure 1B:
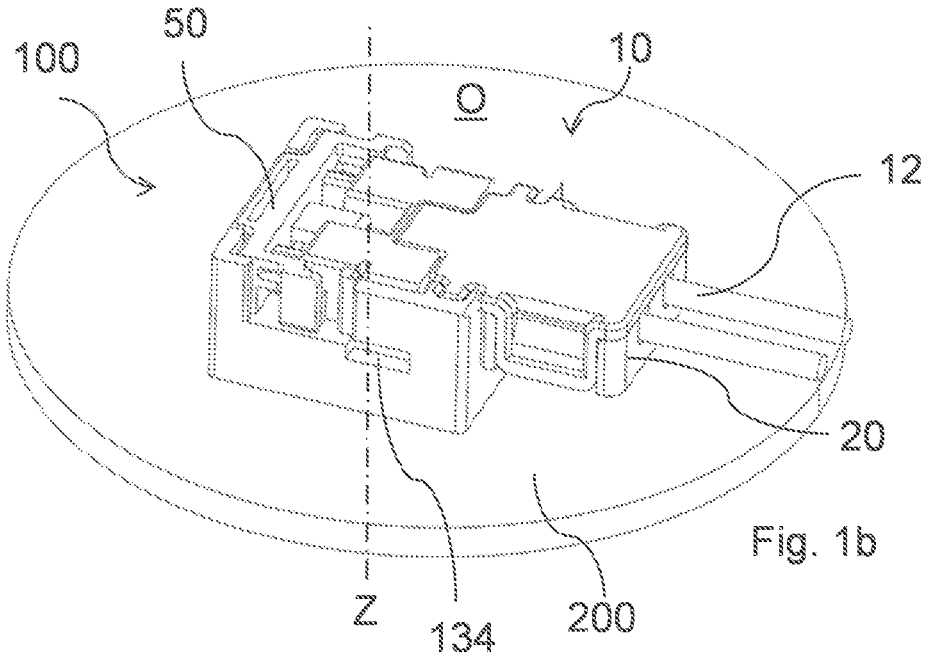
FIG. 1*b* shows a schematic illustration of the connector assembly in a connected state in accordance with one embodiment.

FIG. 1*a* shows an electrical connector assembly for airbag restraint systems in a disconnected status. The electrical connector assembly including a first connector 10 having an elongated housing 20 aligned along a longitudinal axis X. A first connection face 11 facing perpendicular to the longitudinal axis X, along a mating axis Z perpendicular to the longitudinal axis X. The first connector 10 including first locking means to lock the first connector 10 to a second connector 100 and second locking means that prevent the first locking means from releasing. The connector assembly further including the second connector 100 having a second connection face 110, surrounded at least partly by a shroud 101, facing along the mating axis Z, towards the first connection face 11. The shroud 101 includes third locking means that cooperate with the first locking means to lock the first connector 10 to the second connector 100 when mated along the mating axis Z. The extension of the mated connector assembly, along the mating axis Z, is smaller than the extension along the longitudinal axis X and also smaller than the extension along a transverse axis Y arranged perpendicular to the longitudinal axis X and the mating axis Z. The first locking means is a protrusion 34 protruding outwards from the elongated housing 20 along the transverse axis Y. The protrusion 34 is arranged on a free end of a flexible arm 33. The flexible arm extends from the elongated housing 20 along the mating axis Z towards the second connector 100. The second connector is attached on a base plate 200 of an airbag restraint system. FIG. 1*b* shows an electrical connector assembly in an electrically connected with open connector position assurance device 50.

Figure 2:
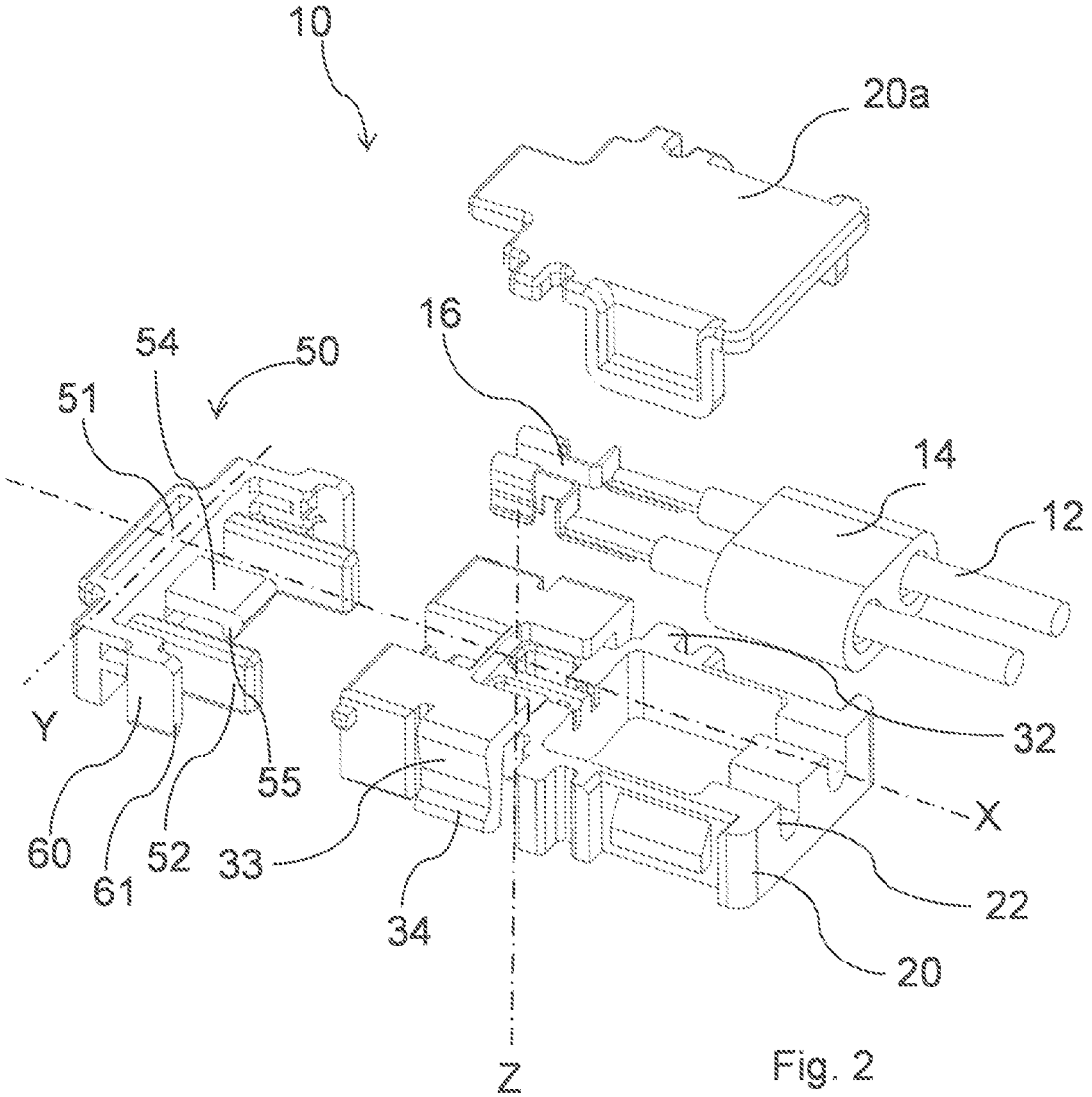
FIG. 2 shows an exploded illustration of the first connector as illustrated in FIGS. 1*a* and 1*b* in accordance with one embodiment.

FIG. 2 shows an exploded illustration of the first connector 10 illustrated in FIGS. 1*a* and 1*b*. The flexible arm 33 extends along mating axis Z at the same distance as the elongated housing 20. The second locking means is a connector position assurance device 50 attached to the elongated housing 20. The connector position assurance device 50 is movable along the longitudinal axis X between an open position O and a blocked position B, when the connector assembly is mated. The connector position assurance device 50 includes a main part 51 aligned along the transverse axis Y. The connector position assurance device 50 includes also a bar shaped portion 52 protruding from the main part 51 along the longitudinal axis X towards the elongated housing 20. The connector position assurance device 50 includes also a safety arm 60 to lock the connector position assurance device 50 in an unmated condition. The safety arm 60 protruding from the main part 51 along the longitudinal axis X towards the elongated housing 20. An outwardly sloped safety surface 61 is arranged on the safety arm 60, the second connector includes a post 160 (see FIG. 3*b*) protruding along the mating axis Z, having an inwardly sloped release surface 161. After mating the sloped safety surface 61 and the sloped release surface 161 cooperate in the way that the safety arm 60 is moved outwardly and the connector position assurance device 50 is movable from the open position O to the blocked position B. Furthermore the connector position assurance device 50 includes a final lock protrusion 55 protruding along the mating axis Z. The final lock protrusion 55 is protruding from the free end of a final lock arm 54, protruding from the main part 51 along the longitudinal axis X towards the elongated housing 20. The final lock protrusion 55 is adapted to cooperate with an edge (not shown) in the elongated housing 20 to lock the connector position assurance device 50 in the blocked position B. The elongated housing 20 includes cavities to receive terminals 16 attached to electrical wires 12 a Ferrite element 14 surrounding the electrical wires 12. In this embodiment the elongated housing 20 has a cap 20*a* that covers the cavities. The elongated housing 20 includes openings 22 for guiding the electrical wires 12 through the elongated housing 20. The connector position assurance device 50 is attached opposite to the openings 22 at the elongated housing 20. The elongated housing 20 includes a rib 32 extending along the mating axis Z and the shroud 101 includes a groove 132 (see FIG. 3*b*) extending along the mating axis Z. The rib 32 is received in the groove 132 while mating and guide the first connector 10 inside the second connector 100 while mating.

Figure 3A:
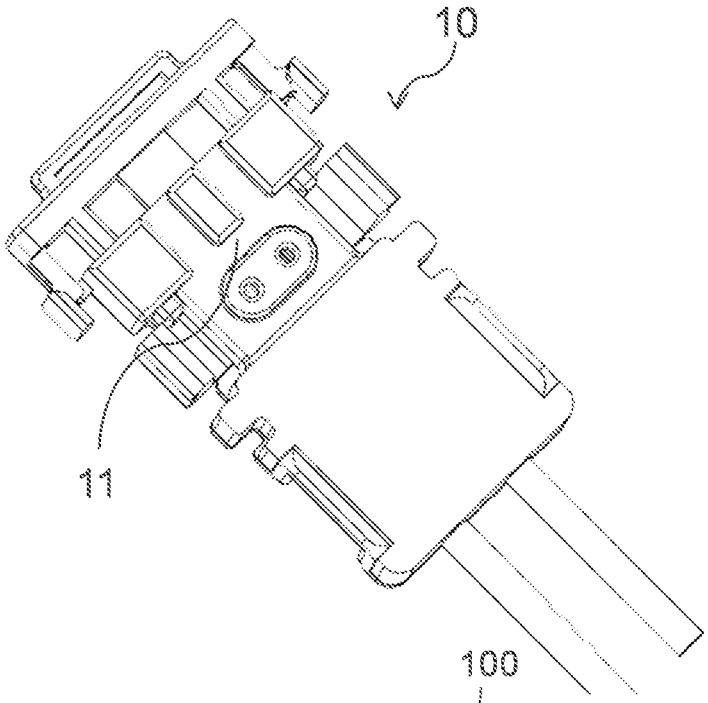
FIG. 3*a* shows a schematic view to the connection face of the first connector in accordance with one embodiment.

FIG. 3*a* shows as schematic view of the first connection face 11.

Figure 3B:
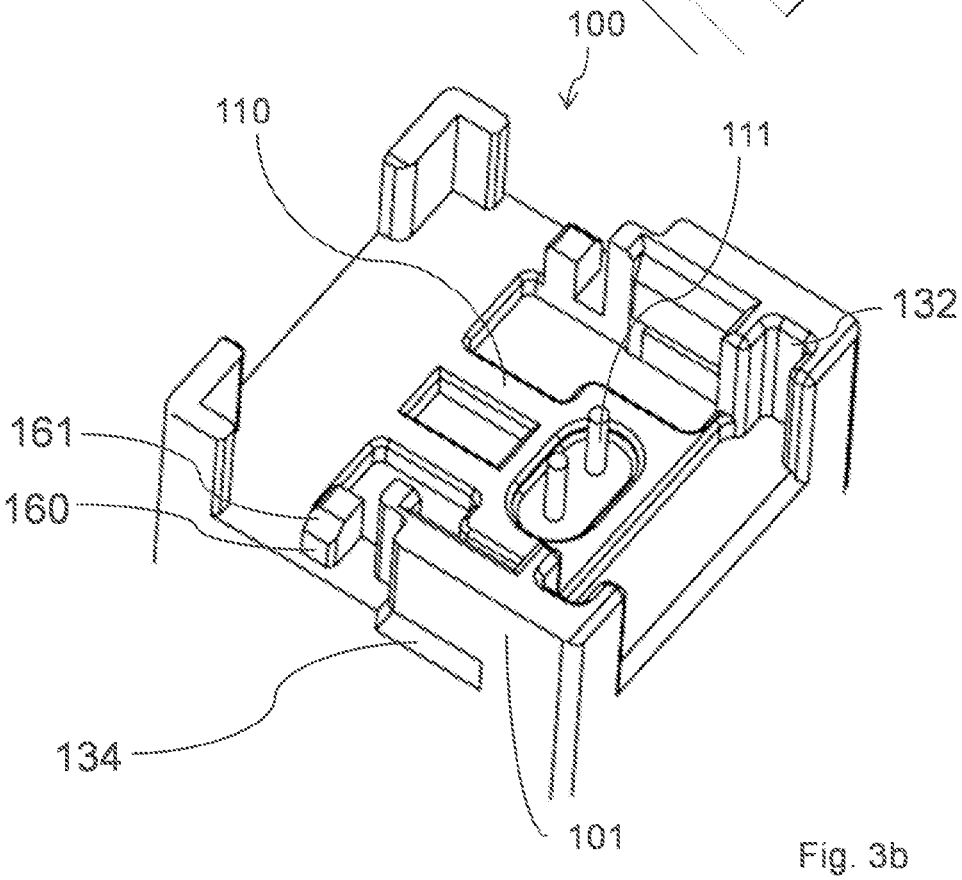
FIG. 3*b* shows a schematic view of the second connector in accordance with one embodiment.

FIG. 3*b* shows as schematic view of the second connector 100. The second connector 100 includes contact elements 111 protruding from the second connection face 110, surrounded at least partly by a shroud 101, along the mating axis Z. The second connector includes a post 160 protruding along the mating axis Z, having an inwardly sloped release surface 161. After mating the sloped safety surface 61 and the sloped release surface 161 cooperate in the way, that the safety arm 60 is moved outwardly and the connector position assurance device 50 is movable from the open position O to the blocked position B. The third locking means is an edge 103 (see FIGS. 5*a*, 5*b*, FIGS. 6*a*, 6*b*) defined by a recess 134 in an inner wall of the shroud 101.

Figure 4A:
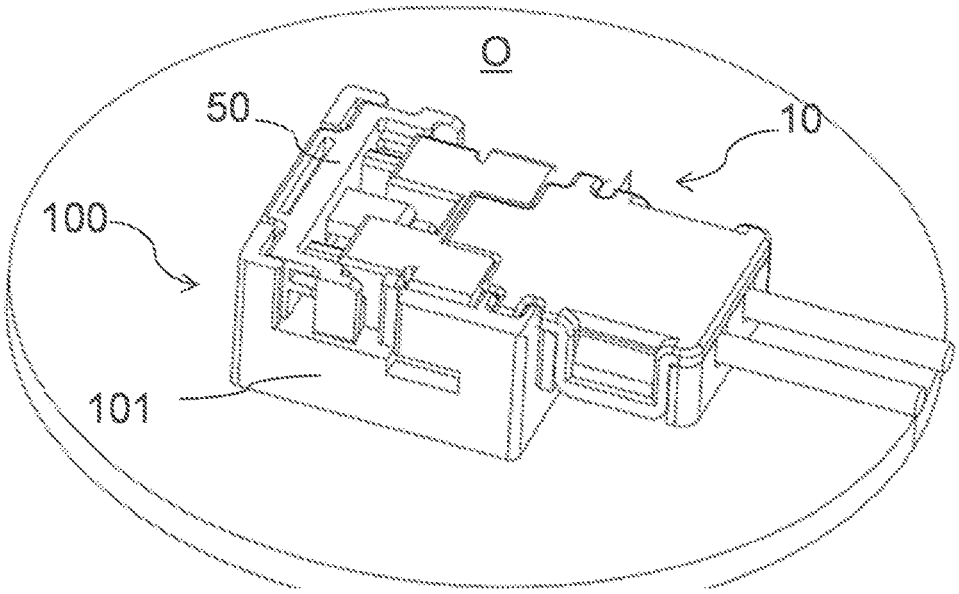
FIG. 4*a* shows a schematic illustrations of the connector assembly with a connector position assurance device in an open position in accordance with one embodiment.
Figure 4B:
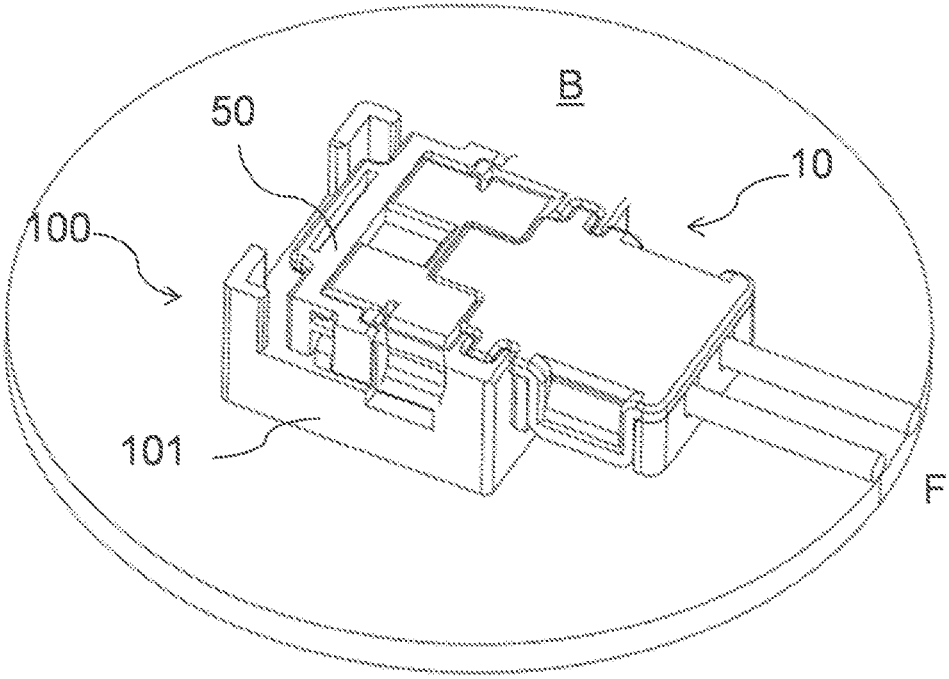
FIG. 4*b* shows a schematic illustrations of the connector assembly with the connector position assurance device in a in closed position in accordance with one embodiment.

FIG. 4*a* shows as schematic view of the electrical connector assembly in a connected state. The connector position assurance device 50 is in an open position O. FIG. 4*b* shows the view of FIG. 4*a* in which the connector position assurance device 50 is in a blocked position B.

Figure 5A:
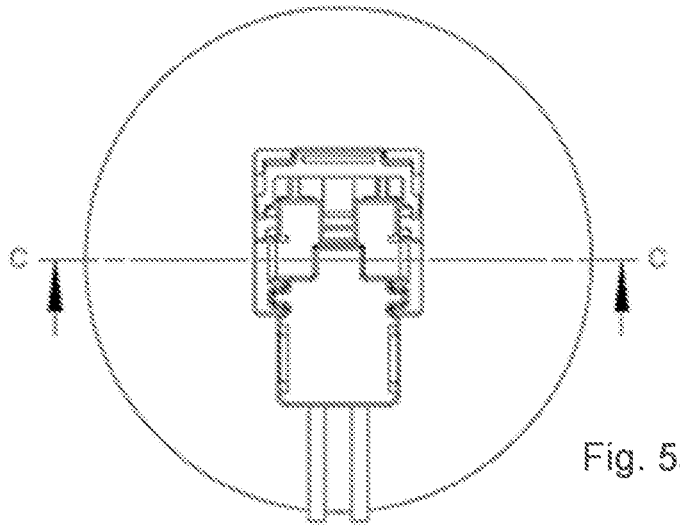
FIGS. 5*a* and 5*b* show a cross section view of the connector assembly along the transverse axis, with the connector position assurance device in an open position in accordance with one embodiment.
Figure 5B:
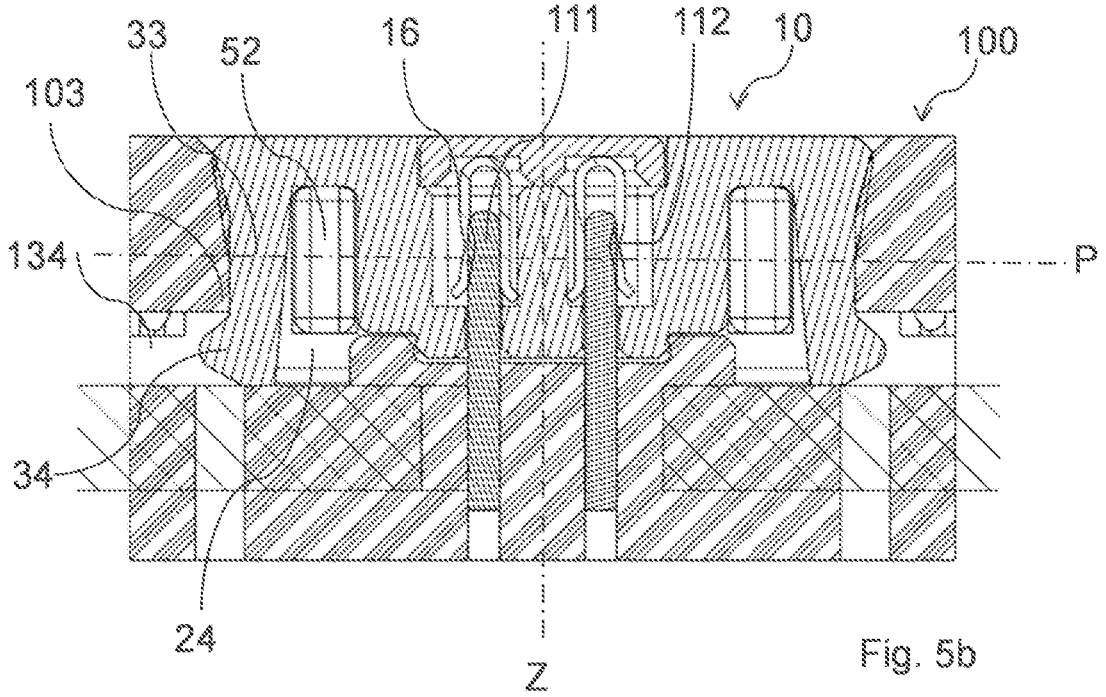

FIG. 5*b* shows a cross section view of the connector assembly shown in FIG. 5*a* with a cut along the axis C as shown in the top view above the cross section view in FIG. 5*a*. The connector position assurance device 50 is in the open position O. The bar shaped portion 52 has a rectangular cross section and is partly inserted in the guide cavity 24 having also a rectangular cross section. When the connector position assurance device 50 is in the open position O the flexible arm 33 is able to be bent inwards the guide cavity 24. The protrusion 34 protruding outwards from the elongated housing 20, along the transverse axis Y into a recess 134 in the wall of the shroud 101. The edge 103 defined by the recess 134 locks the protrusion 34 and prevents movement along the mating axis Z.

Figure 6A:
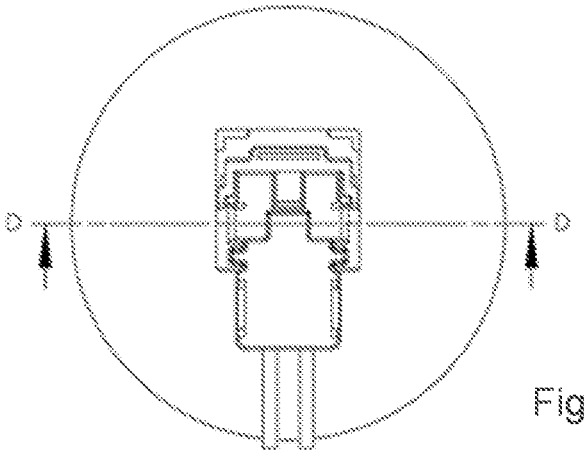
FIGS. 6*a* and 6*b* show a cross section view of the connector assembly along the transverse axis, with the connector position assurance device in a blocked position in accordance with one embodiment.
Figure 6B:
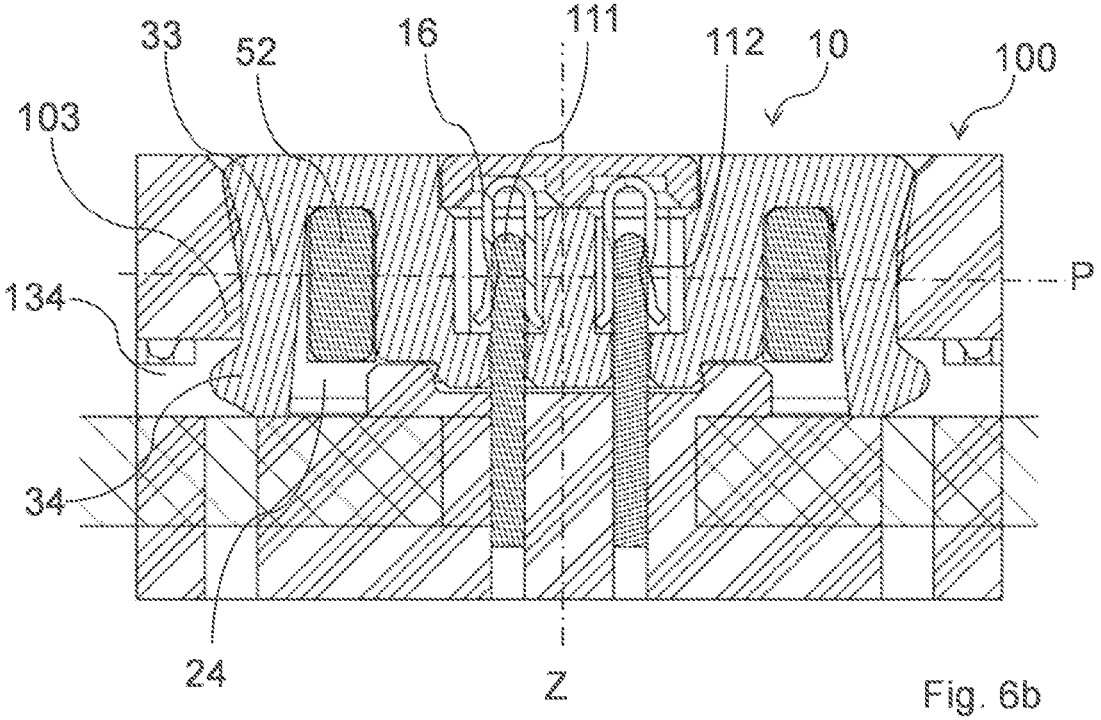

FIG. 6*b* shows a cross section view of the connector assembly shown in FIG. 6*a* with a cut along the axis D as shown in the top view above the cross section view in FIG. 6*a*. The connector position assurance device 50 is in the blocked position B. The bar shaped portion 52 is fully inserted in the guide cavity 24. When the connector position assurance device 50 is in the blocked position B the flexible arm 33 is not able to be bent inwards the guide cavity 24. The protrusion 34 protruding outwards from the elongated housing 20, along the transverse axis Y into the recess 134 in the wall of the shroud 101. The edge 103 defined by the recess 134 locks the protrusion 34 and prevents movement along the mating axis Z. The first connector 10 includes terminals 16 and the second connector 100 includes contact elements 111. In a plane P, spanned by the longitudinal axis X and transverse axis Y, at least, a portion of the terminals 16 and a portion of the contact elements 111 and a portion of the bar shaped portion 52 and a portion of the flexible arm 33, is present in at least at one point along the mating axis Z. The terminals 16 and the contact elements 111 have contacting points 112 between the terminals 16 and the contact elements 111. A portion of the bar shaped portion 52 and a portion of the flexible arm 33 and the contacting points 112, is arranged in a row along the transverse axis Y.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

While terms of ordinance or orientation may be used herein, these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising;

a first connector having an elongated housing aligned along a longitudinal axis, a first connection face oriented generally parallel to a mating axis perpendicular to the longitudinal axis; and a second connector having a second connection face surrounded at least partly by a shroud oriented generally parallel to the mating axis towards the first connection face, wherein said first connector comprises a first locking means configured to lock the first connector to the second connector and second locking means that prevent the first locking means from releasing, wherein the shroud comprises a third locking means that cooperates with the first locking means to lock the first connector to the second connector when mated along the mating axis, wherein a length of the electrical connector assembly along the mating axis, is smaller than a width along the longitudinal axis and also smaller than a height along a transverse axis arranged perpendicular to the longitudinal axis and the mating axis, when mated.

2. The electrical connector assembly according to claim 1, wherein the first locking means is a protrusion projecting outwardly from the elongated housing along the transverse axis.

3. The electrical connector assembly according to claim 2, wherein the protrusion is arranged on a free end of a flexible arm and wherein the flexible arm extends from the elongated housing along the mating axis towards the second connector.

4. The electrical connector assembly according to claim 3, wherein the flexible arm extends along the mating axis at the same distance as the elongated housing.

5. The electrical connector assembly according to claim 4, wherein the third locking means is an edge defined by a recess in an inner wall of the shroud.

6. The electrical connector assembly according to claim 5, wherein the second locking means is a connector position assurance device attached to the elongated housing and wherein the connector position assurance device is movable along the longitudinal axis between an open position and a blocked position, when the electrical connector assembly is mated.

7. The electrical connector assembly according to claim 6, wherein the connector position assurance device comprises a main part aligned along the transverse axis.

8. The electrical connector assembly according to claim 7, wherein the connector position assurance device comprises a bar shaped portion protruding from the main part along the longitudinal axis towards the elongated housing and wherein the elongated housing comprises a guide cavity aligned along the longitudinal axis, and wherein the bar shaped portion is movable inside the guide cavity along the longitudinal axis, when the electrical connector assembly is mated.

9. The electrical connector assembly according to claim 8, wherein the bar shaped portion and the guide cavity have a rectangular cross section.

10. The electrical connector assembly according to claim 9, wherein the elongated housing comprises openings for guide through electrical wires and wherein the connector position assurance device is attached opposite to the openings at the elongated housing, wherein the connector position assurance device is moved towards the openings while moving from the open position to the blocked position.

11. The electrical connector assembly according to claim 10, wherein the first connector comprises terminals and the second connector comprises contact elements, wherein in a plane, spanned by the longitudinal axis and the transverse axis, at least, a portion of the terminals and a portion of the contact elements and a portion of the bar shaped portion and a portion of the flexible arm, is present, in at least at one point along the mating axis.

12. The electrical connector assembly according to claim 10, wherein the first connector comprises terminals and the second connector comprises contact elements, wherein contacting points between the terminals and the contact elements and a portion of the bar shaped portion and a portion of the flexible arm is arranged in a row along the transverse axis.

13. The electrical connector assembly according to claim 10, wherein the connector position assurance device comprises a safety arm to block the connector position assurance device in an unmated condition, the safety arm protruding from the main part along the longitudinal axis towards the elongated housing, comprising an outwardly sloped safety surface that is arranged on the safety arm, the second connector comprises a post protruding along the mating axis having an inwardly sloped release surface, after mating the sloped safety surface and the sloped release surface cooperate in the way that the safety arm is moved outwardly and the connector position assurance device is movable from the open position to the blocked position.

14. The electrical connector assembly according to claim 13, wherein the connector position assurance device comprises a final lock protrusion protruding along the mating axis, wherein the final lock protrusion is protruding from the free end of a final lock arm, protruding from the main part along the longitudinal axis towards the elongated housing, wherein the final lock protrusion is adapted to cooperate with an edge in the elongated housing to lock the connector position assurance device in the blocked position.

15. The electrical connector assembly according to claim 14, wherein the elongated housing comprises a rib extending along the mating axis and the shroud comprises a groove extending along the mating axis, wherein the rib is received in the groove while mating, guiding the first and second connectors while mating.

* * * * *